United States Patent [19]

Perkins

[11] 4,143,798

[45] Mar. 13, 1979

[54] SAFETY STRAPS FOR HOLSTERS

[75] Inventor: Neale A. Perkins, Sierra Madre, Calif.

[73] Assignee: Safariland Ltd. Inc., Monrovia, Calif.

[21] Appl. No.: 776,316

[22] Filed: Mar. 10, 1977

Related U.S. Application Data

[60] Continuation-in-part of Ser. No. 663,545, Mar. 3, 1976, abandoned, which is a division of Ser. No. 529,898, Dec. 5, 1974, Pat. No. 3,955,724.

[51] Int. Cl.[2] ..... F41C 33/02

[52] U.S. Cl. ..... 224/243; 224/911

[58] Field of Search ..... 224/2 B, 2 C, 2 D, 2 E, 224/2 F, 2 A, 3, 26 R, 5 R; 24/213 R, 216, 220, 201 R, 31 L, 33 L, DIG. 17, 208 R, 208 A

[56] References Cited

U.S. PATENT DOCUMENTS

| | | | |
|---|---|---|---|
| 712,622 | 11/1902 | Traut | 24/216 |
| 1,661,537 | 3/1928 | Knapp | 24/208 A |
| 1,946,954 | 2/1934 | Ventura | 24/208 A |
| 2,031,699 | 2/1936 | Fassett | 24/208 A |
| 2,917,213 | 12/1959 | Bucheimer et al. | 224/2 B |
| 3,002,246 | 10/1961 | Carpinella et al. | 24/216 |
| 3,083,430 | 2/1963 | Shears | 24/216 |
| 3,576,278 | 4/1971 | Eastman | 224/2 D |

*Primary Examiner*—Trygve M. Blix
*Assistant Examiner*—Sherman D. Basinger
*Attorney, Agent, or Firm*—Christie, Parker & Hale

[57] ABSTRACT

A holster includes a safety strap which extends over a firearm carried in the holster, and a snap ring fastener on the inside surface of the holster for securing the end of the safety strap. A shield having a hardness less than that of the fastener extends around the fastener and projects into the interior of the holster beyond the fastener. The shield prevents the firearm from contacting the fastener when the firearm is removed or replaced in the holster which prevents abrasion of the firearm or its protective finish otherwise caused by repeated contact between the firearm and the unshielded fastener.

17 Claims, 11 Drawing Figures

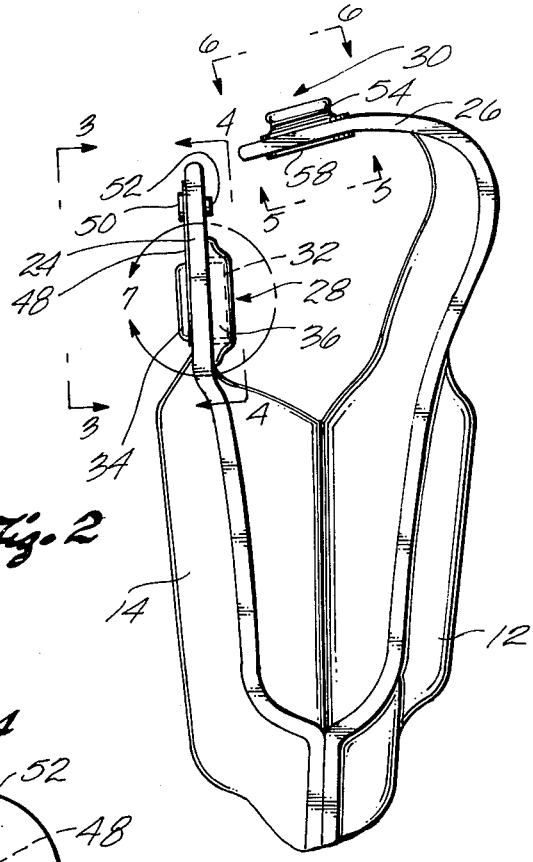
Fig. 2
Fig. 4
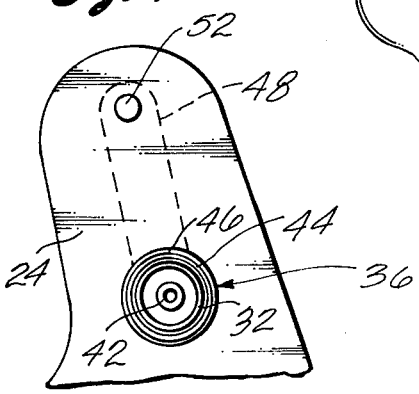
Fig. 6
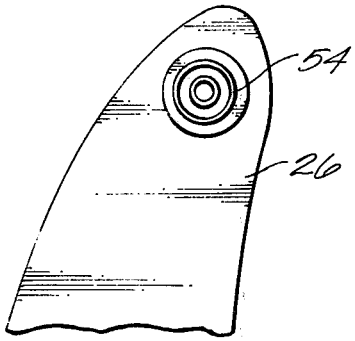
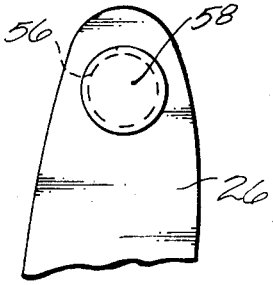
Fig. 5
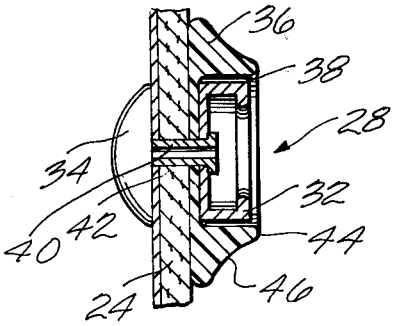
Fig. 7

SAFETY STRAPS FOR HOLSTERS

CROSS-REFERENCE TO RELATED APPLICATIONS

This is a continuation-in-part of application Ser. No. 663,545, filed Mar. 3, 1976, now abandoned which, in turn, is a division of application Ser. No. 529,898, filed Dec. 5, 1974, now U.S. Pat. No. 3,955,724.

BACKGROUND

This invention relates to holsters, and more particularly to an improved safety strap for holsters.

Holsters commonly have a safety strap for holding a firearm in the holster. Safety straps typically extend over the hammer or across the frame of the firearm, and a snap ring fastener on the safety strap is releasably secured to a cooperating snap ring fastener on the holster. In many holsters the female snap ring fastener is located in an upper region of the holster and projects into the interior of the holster. As a result, the firearm repeatedly comes into contact with the fastener when the firearm is removed from or replaced in the holster. By way of example, holsters are typically formfitted to the shape of the firearm so that the firearm makes an exceedingly tight fit in the holster. When removing or replacing a firearm from such a holster, the user virtually cannot avoid drawing the firearm across the projecting safety strap fastener. Such repeated contact eventually results in scratching the barrel or cylinder or slide of the firearm or abrading away the protective finish of the firearm. The firearm is susceptible to corrosion because of such wear. Thus, it is common for the firearm owner to periodically have the protective finish reapplied, i.e., "re-blued", to avoid corrosion or other damage to the firearm.

For years the problem of wear caused by repeated contact with the safety strap fastener has been a problem for firearm owners. The problem is especially significant to law enforcement officers who are constantly removing and replacing their firearms in their holsters during duty and even off-duty during target practice, for example. It is an unfortunate result that many expensive firearms must be refinished because of such wear inasmuch as refinishing of the firearm significantly diminishes its value. For example, to re-blue a firearm, the firearm must be disassembled, the edges of the metal are often buffed away prior to chemically applying the protective finish, and it is quite apparent that the surface has been refinished. All of this leads to a reduction in the value of the firearm.

Further, the cost of refinishing a firearm can amount to 25-30% of the original cost of the weapon.

The present invention overcomes these disadvantages by providing a holster safety strap which prevents wear from repeated contact between a snap ring fastener and a firearm.

SUMMARY OF THE INVENTION

Briefly, the invention includes a holster having a safety strap, a snap ring fastener secured to an inner surface of the holster for releasably holding the safety strap over a firearm in the holster, and a shield surrounding the snap ring fastener. The shield extends into the interior of the holster farther than the snap ring fastener so that removing or replacing the firearm in the holster causes the firearm to contact only the shield and not the fastener. The shield is made from a material having a hardness less than that of the snap ring fastener, the hardness of the shield being sufficient to prevent abrasion of a firearm or its finish under repeated contact with the shield. Preferably, the shield is made from a relatively soft plastic material.

In a preferred form of the invention, the shield and the snap ring fastener are recessed in the wall of the holster so as to reduce the distance by which they project into the holster.

Thus, in holster designs in which firearms have previously experienced repeated contact with the safety strap fastener, the shield of this invention prevents wear on the firearm finish caused by such repeated contact. In certain holster designs, the recessed embodiment of the shield and snap ring fastener also reduces the amount of contact, which further aids in preventing wear on the firearm, as well as reducing interference between the firearm and the fastener when the firearm is being removed from the holster. To further reduce the amount of such interference, an embodiment of the invention provides a tapered outer surface on the shield to reduce drag between the firearm and the shield.

These and other aspects of the invention will be more fully understood by referring to the following detailed description and the accompanying drawings.

DRAWINGS

FIG. 2 is a fragmentary elevation view taken on line 2—2 of FIG. 1 and showing shielded male and female snap ring fasteners according to this invention;

FIG. 4 is a fragmentary elevation view taken on line 4—4 of FIG. 2 and showing an inside portion of the female snap ring fastener;

FIG. 5 is a fragmentary elevation view taken on line 5—5 of FIG. 2 and showing an inside portion of the male snap ring fastener;

FIG. 6 is a fragmentary elevation view taken on line 6—6 of FIG. 2 and showing an outside portion of the male snap ring fastener;

FIG. 7 is a fragmentary cross-sectional elevation view showing the female snap ring fastener within the circle 7 of FIG. 2;

DETAILED DESCRIPTION

Figure 1:
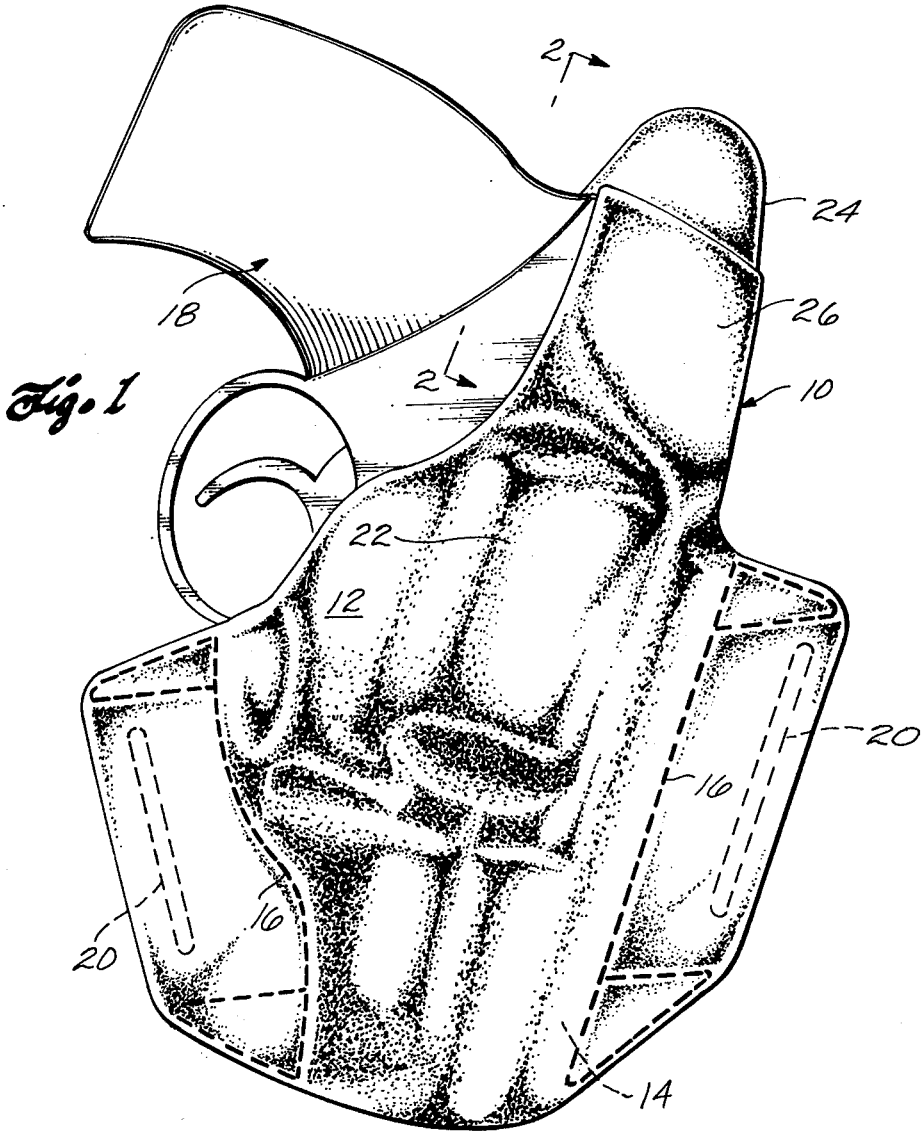
FIG. 1 is an elevation view showing a holster according to this invention.

Referring to the drawings, a holster 10 includes a pair of front and rear leather panels 12 and 14, respectively, secured together by stitching 16 at opposite ends of the panels. A firearm 18 is carried in the hollow interior formed in the holster between the panels. The holster is worn by a belt (not shown) threaded through a pair of spaced apart belt openings 20 extending through the rear panel 14. Both panels are pressure-molded at 22 to match the shape of the firearm. This enables the firearm to make a snug fit in the holster.

An upwardly extending projection 24 of the rear panel 14 extends above the hammer of the firearm. The front panel 12 has a safety strap 26 which loops over the hammer of the firearm and, in use, terminates adjacent the inner surface of the projection 24. A female snap ring fastener 28 (see FIG. 2) is secured to the projection 24, and a male snap ring fastener 30 is secured to an end portion of the safety strap 26. In use, the male and female snap ring fasteners are releasably snapped together to hold the safety strap 26 over the hammer of the firearm. The snap ring fasteners can be released by thumb-pressure exerted on the extension 24 to free the safety strap 26 prior to removing the firearm 18 from the holster.

This invention provides a means for shielding the female and male snap ring fasteners 28, 30 to prevent wear on the firearm 18 from repeated contact with the portions of the fasteners located on the inner surfaces of the holster. The invention is described in the context of the type of holster illustrated in the drawings, but it will be understood that the invention can be used on other types of holsters faced with the problem of wear on the firearm or its finish from repeated contact with a snap ring fastener facing the interior region of the holster where the firearm is carried.

Referring especially to FIG. 7, the female snap ring fastener 28 includes a snap ring fastening element in the form of a circular receptacle 32 and an attachment element in the form of a rivet 34 securing the receptacle to the extension portion 24 of the holster. A circular shield 36 surrounds the entire outer surface of the receptacle 32. The shield 36 is formed generally as a cup having a large circular bore 38 for holding the receptacle 32. The large bore 38 is stepped down to form a narrow bore 40 through which a shank 42 of the rivet 34 extends for rigidly securing the receptacle in the large bore 38 of the shield. The depth of the shield 36 is such that an outer marginal edge 44 of the shield projects into the interior of the holster beyond the outer lip of the receptacle 32. Thus, when a firearm is withdrawn from or replaced in the holster, any portion of the firearm which would otherwise contact the receptacle 32 instead contacts the shield 36. The shield also has an outer surface 46 which tapers narrower in a radial direction away from the axis of the shield. This tapered surface reduces drag on a firearm drawn across the shield 36.

The shield 36 is made from a material having a hardness less than that of the fastener receptacle 32. The comparative hardness of the shield is sufficiently low that, whereas a metal receptacle will abrade a firearm, or at least its protective surface finish, the shield will not cause such abrasion. The metal typically used in firearms is steel, and sometimes alloyed aluminum, and the metal typically used in snap ring fasteners, is steel or brass. The preferred material for the shield is a rigid, but relatively soft plastic, the presently preferred plastic being polyvinyl chloride. Thus, the shield is sufficiently rigid to stay in position to protect the firearm from contact with the fastener ring, but the plastic is sufficiently soft so that if any abrasion occurs, it is to the surface of the plastic shield and not the firearm or its protective surface.

Figure 3:
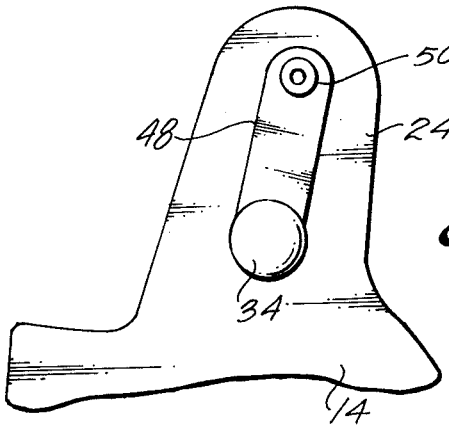
FIG. 3 is a fragmentary elevation view taken on line 3—3 of FIG. 2 and showing an outside portion of the female snap ring fastener.

The receptacle 32 is secured to the holster through an elongated reinforcing member 48, preferably a strip of blue clock spring steel, which overlies the outer surface of the inner panel extension 24. The reinforcing strip 48 has a pair of longitudinally spaced apart holes near its opposite ends. The top end of the reinforcing strip 48 (as viewed in FIGS. 2 and 3) is secured to the holster by a rivet 50 which extends through a hole in the top of the strip and through a corresponding hole in the holster. The shank portion of the rivet 50 is pressfitted into a receptacle of a T-nut 52 on the inside of the holster. The rivet 34 of the female snap ring fastener 28 extends through the hole in the lower end of the reinforcing strip 48 to reinforce the attachment of the female snap ring fastener to the holster.

The male snap ring fastener 30 includes a shank 54 which projects outwardly from the outer surface of the safety strap 26. The shank 54 is secured to the safety strap 26 by a rivet 56 having its head overlying the inside surface of the safety strap. The head portion 58 of the rivet 56 is typically made of metal, such as steel or brass, and also can pose a problem of abrading a firearm or its finish from the firearm repeatedly being removed from or replaced in the holster. To overcome this problem, the head of the rivet 56 is coated with a soft layer 58 of plastic, such as polyvinyl chloride. The layer is sufficient to be relatively resilient so as to avoid any possibility of abrasion to the firearm or its protective coating. Preferably, the plastic layer 58 is applied to the rivet head by a dipping process, after which the coated rivet is secured to a holster by an automatic snap setter.

Figure 8:
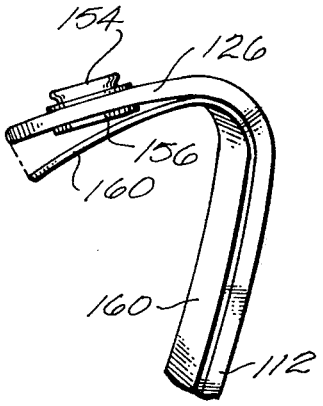
FIG. 8 is a fragmentary elevation view showing an alternate means of shielding the male snap ring fastener.

The holster shown in FIGS. 1 through 7 is, for simplicity, shown as being made from relatively thin leather panels and without interior lining. FIG. 8 shows a holster having an alternate means of protecting the firearm from contact with the male snap ring fastener. In this instance, the safety strap 126 is made of leather and has an interior lining 160, such as a layer of orthopedic elk suede. The male snap ring fastener includes the usual shank 154 on the outside of the safety strap 126, and the metal rivet head 156 on the inside of the safety strap. In this instance, the liner 160 completely covers the rivet head 156 and is stitched around the periphery of the safety strap 126 to completely shield the firearm from contact with the rivet head 156.

Figure 9:
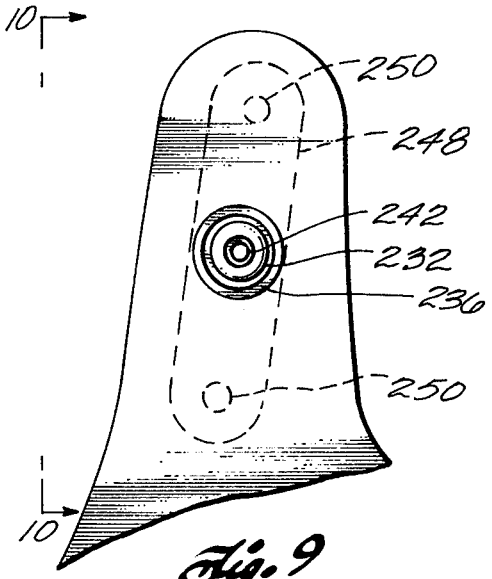
FIG. 9 is a fragmentary elevation view showing an alternate means for securing the female snap ring fastener to the holster.
Figure 10:
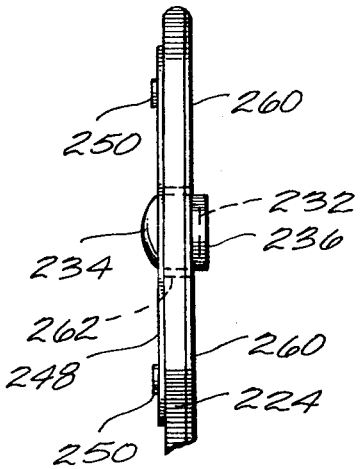
FIG. 10 is a fragmentary elevation view taken on line 10—10 of FIG. 9.
Figure 11:
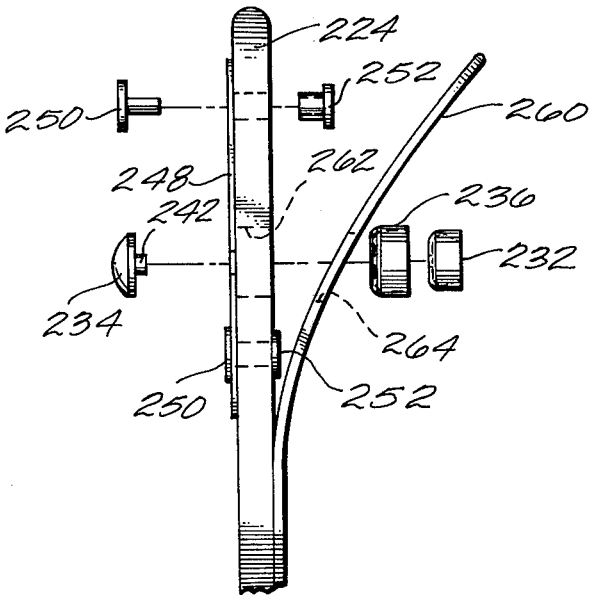
FIG. 11 is a fragmentary exploded elevation view similar to FIG. 10.

FIGS. 9 through 11 illustrate an alternate means of attaching a shielded female snap ring fastener to a holster. This embodiment comprises a holster made of leather panels of greater thickness than the holster shown in FIGS. 1 through 7. In this instance, the shielded female snap ring fastener is recessed in the thicker leather panel to reduce the distance by which it protrudes into the interior of the holster. In this way, contact with the firearm is not only shielded from destructive abrasion, but contact also is potentially minimized, if not eliminated, by the recessed structure of the fastener. The fastener is recessed by mounting it in a hole 262 extending through the leather panel 224 of the holster. A plastic shield 236 is seated in the hole, and a receptacle 232 of the female fastener is seated in the shield 236. The shield is made from the same relatively soft material as the shield 36. The receptacle 236 is held in place in the shield by a rivet 234 having a shank 242 extending through an elongated reinforcing strip 248 which bridges the recessed hole 262. The shank 242 of the rivet 234 extends through the interior of the shield and is rigidly secured to the interior of the receptacle 232. The head portion of the rivet 234 bears against the reinforcing strip 248 and rigidly secures the shielded receptacle in the recessed hole 262. The shield 236 fits snugly in the hole 262 to avoid any significant lateral movement of the shield or receptacle.

The opposite ends of the reinforcing strip 248 are secured to the leather panel 224 by spaced apart rivets 250 and T-nuts 252. The inside surface of the leather panel 224 can have a lining 260 having a hole 264 which extends around the outside of the reinforced receptacle 232. As shown best in FIG. 10, the distance by which the shield and receptacle extend into the interior of the holster is minimized by the recessed structure, which minimizes contact between the firearm and the shield, as well as the shield preventing any destructive abrasion to the firearm in the event the firearm does contact the shield.

I claim:

1. In a holster for carrying a firearm and comprising a case having a safety strap for securing a firearm in the case, a metal snap ring fastener secured to an inside surface portion of the case for use in holding the safety strap over the firearm, the snap ring fastener having a peripheral wall extending a predetermined distance into the interior of the case, the improvement comprising a shield surrounding the peripheral wall of the snap ring fastener, the shield being made from a material having a hardness less than that of the peripheral wall, the shield and the snap ring fastener being disposed in a hole formed in the case to recess the shield and the fastener with respect to the inside surface of the case, a reinforcing member overlying an outside surface of the case so as to bridge the hole in the case, and an attachment element extending through the reinforcing member for securing the shield and the snap ring fastener in the hole of the case, the shield extending farther into the interior of the case than said peripheral wall so a firearm removed from or replaced in the case can slide against the shield and not the peripheral wall of the fastener.

2. The improvement according to claim 1 in which the shield is made of plastic.

3. The improvement according to claim 1 in which the shield is shaped as a cup having a bottom wall, a hollow interior, and an opening through the bottom wall, the attachment element securing the bottom wall of the cup in the hole of the case so the interior of the cup faces away from said interior surface portion, the snap ring fastener being disposed in the interior of the cup against the bottom wall thereof, the attachment element extending through the reinforcing member and through the opening in the cup and into the snap ring fastener for securing the snap ring fastener and the shield in the hole in the case.

4. A holster for carrying a firearm comprising:

a case having a hollow interior for carrying a firearm, and an elongated safety strap for extending over the firearm to hold the firearm in the interior of the case;

a first snap ring fastener secured to the safety strap;

a second snap ring fastener for being secured to an inside surface of the case and for cooperating with the first snap ring fastener to releasably secure the safety strap over the firearm, the second snap ring fastener having a peripheral wall extending a predetermined distance into the interior of the case;

a shield surrounding said peripheral wall of the second snap ring fastener, the shield being made from a material having a hardness less than that of the peripheral wall;

the shield being shaped as a cup having a bottom wall, a hollow interior, and an opening through the bottom wall, the bottom wall of the cup being disposed inside a hole formed in the case so the shield is recessed in the inside surface of the case and the interior of the cup faces away from said inside surface, the second snap ring fastener being disposed in the interior of the cup against the bottom wall thereof, a reinforcing member overlying an outside surface of the case and bridging the hole in the case, and a third fastener extending through the reinforcing member and the opening in the cup into the second snap ring fastener for securing the second snap ring fastener and the shield in the hole in the case;

the shield extending farther into the interior of the case than the peripheral wall of the second snap ring fastener so that removing or replacing the firearm in the case causes the firearm to slide against the shield and not the peripheral wall of the second snap ring fastener.

5. A holster according to claim 4 in which the peripheral wall is made of metal.

6. A holster according to claim 5 in which the shield is made of plastic.

7. A holster according to claim 4 in which the safety strap has an outer surface and an inner surface, and the first snap ring fastener includes a snap ring fastening element on said outside surface for cooperating with the second snap ring fastener to releasably secure the safety strap over the firearm; the first snap ring fastener further including an attachment element for securing the snap ring fastening element to the safety strap, the attachment element being on the inside surface of the safety strap; and means on the inside surface of the safety strap to cover the attachment element to shield it from contact with a firearm being removed or replaced in the case.

8. A holster according to claim 7 including a coating of material on the attachment element having a hardness less than that of the attachment element.

9. A holster according to claim 8 in which the coating comprises a resilient plastic material.

10. A holster according to claim 7 in which the peripheral wall of the second snap ring fastener is made of metal and the shield is made of plastic.

11. A holster according to claim 4 in which the shield is a ring-shaped member extending entirely around the outer peripheral surface of the second snap ring fastener.

12. A holster for carrying a firearm comprising:

a case having a hollow interior for carrying a firearm and a safety strap for securing the firearm in the case;

a snap ring fastener secured to a wall portion of the case for use in holding the safety strap over the firearm, said wall portion having an inside surface and an outside surface, and a hole extending through it between the outside and inside surfaces;

the snap ring fastener having a snap ring fastening element facing the interior of the case and an attachment element securing the snap ring fastening element to said wall portion;

a shield surrounding the snap ring fastening element for preventing contact between a firearm and the fastening element; and means securing the snap ring fastener to said wall portion comprising a reinforcing member overlying the outer surface of said wall portion so as to bridge the hole in said wall portion, the shield and the snap ring fastening element being disposed in said hole to recess them with respect to the inner surface of the case, the attachment element extending through the reinforcing member and the shield, and means securing the attachment element to the snap ring fastening element so the latter faces the inside of the case;

the shield surrounding the snap ring fastening element and being made from a material having a hardness less than that of the snap ring fastening element, the shield extending farther into the interior of the case than the snap ring fastening element so that removing or replacing the firearm in the case causes the firearm to slide against the shield and not the snap ring fastening element.

13. A holster according to claim 12 in which the snap ring fastening element is made of metal.

14. A holster according to claim 13 in which the shield is made of plastic.

15. A holster according to claim 14 in which the reinforcing member is made of metal.

16. A holster according to claim 12 in which the shield is shaped as a cup having a bottom wall, a hollow interior, and an opening through the bottom wall, the bottom wall of the cup overlying the wall portion of the case so the interior of the cup faces away from said wall portion, the snap ring fastening element being disposed in the interior of the cup against the bottom wall thereof, the attachment element extending through the wall portion of the case and through the opening in the cup and into the snap ring fastening element for securing the snap ring fastening element and the shield to the wall portion of the case.

17. A holster according to claim 16 in which the shield is made of plastic.

* * * * *